US010711966B2

(12) United States Patent
Baba et al.

(10) Patent No.: US 10,711,966 B2
(45) Date of Patent: Jul. 14, 2020

(54) LIGHT SOURCE UNIT AND FIXING METHOD OF LENS THEREOF

(71) Applicant: Koito Manufacturing Co., Ltd., Tokyo (JP)

(72) Inventors: Shinya Baba, Shizuoka (JP); Teppei Muramatsu, Shizouka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/204,029

(22) Filed: Nov. 29, 2018

(65) Prior Publication Data

US 2019/0178461 A1 Jun. 13, 2019

(30) Foreign Application Priority Data

Dec. 7, 2017 (JP) ..... 2017-235408

(51) Int. Cl.

| | |
|---|---|
| ***F21S 41/275*** | (2018.01) |
| ***F21S 41/141*** | (2018.01) |
| ***F21S 41/19*** | (2018.01) |
| ***F21S 41/29*** | (2018.01) |
| ***F21S 45/47*** | (2018.01) |
| ***F21S 41/151*** | (2018.01) |
| ***F21S 41/20*** | (2018.01) |

(52) U.S. Cl.

CPC ..... *F21S 41/275* (2018.01); *F21S 41/141* (2018.01); *F21S 41/151* (2018.01); *F21S 41/192* (2018.01); *F21S 41/285* (2018.01); *F21S 41/29* (2018.01); *F21S 45/47* (2018.01)

(58) Field of Classification Search

CPC ..... F21S 45/47; F21V 29/15; F21V 29/50; F21V 29/504; F21V 29/509

See application file for complete search history.

(56) References Cited

U.S. PATENT DOCUMENTS

2011/0273876 A1* 11/2011 Stolyar ..... F21V 17/101 362/235
2018/0320875 A1* 11/2018 Cho ..... F21V 25/12

FOREIGN PATENT DOCUMENTS

| | | | |
|---|---|---|---|
| CN | 101688654 | A | 3/2010 |
| CN | 102563403 | A | 7/2012 |
| CN | 104344234 | A | 2/2015 |
| JP | 2012-160666 | A | 8/2012 |

* cited by examiner

*Primary Examiner* — Evan P Dzierzynski
*Assistant Examiner* — Keith G. Delahoussaye
(74) *Attorney, Agent, or Firm* — Abelman, Frayne & Schwab

(57) ABSTRACT

A light source includes a substrate on which an excitation light source is mounted, a lens including a light transmitting portion that transmits light from the excitation light source and a body attached to the substrate, a first thermal expansion absorber that protrudes from the body and has high heat resistance and elasticity, and a cover fixed to the substrate in a state where the body of the lens is sandwiched between the cover and the substrate via the first thermal expansion absorber.

9 Claims, 6 Drawing Sheets

LIGHT SOURCE UNIT AND FIXING METHOD OF LENS THEREOF

CROSS-REFERENCE TO RELATED APPLICATIONS

This application is based on and claims priority from Japanese Patent Application No. 2017-235408, filed on Dec. 7, 2017, with the Japan Patent Office, the disclosure of which is incorporated herein in its entirety by reference.

TECHNICAL FIELD

The present disclosure relates to a light source unit in which an excitation light source and a lens that transmits the light of the excitation light source are mounted on a common substrate and a vehicle headlamp of the light source unit.

BACKGROUND

Japanese Patent Laid-Open Publication No. 2012-160666, including FIGS. 1 and 2, and paragraph [0078], discloses an LED module (a light source unit) in which a base portion (a fixing portion to a housing) of a light direction converting element which is an optical system for reflecting the light of the LED portion is fixed by three screws (fixing units to the housing) with respect to a case on which an LED portion (an excitation light source) is mounted.

SUMMARY

An optical system (a light direction converting element or a lens) fixed to a housing or a substrate on which an LED portion (an excitation light source) is mounted receives heat generated in the LED portion during a light emission, from the housing or the substrate through a base portion in some cases. At this time, when fixing the optical system to the housing or the substrate by a plurality of screws so as to surround the light direction converting element via the base portion as described in Japanese Patent Laid-Open Publication No. 2012-160666, there is a problem of deformation of the shape due to the thermal stress occurring at a light reflecting surface of the optical system or a light transmitting portion that transmits light so that the light is not able to be emitted in a predetermined direction.

Considering the above problems, the present disclosure provides a light source unit in which deformation of the shape hardly occurs at a light transmitting portion of a lens even when the light transmitting portion receives heat during the light emission, by fixing the lens that transmits the light of an excitation light source to a substrate on which the excitation light source is mounted, and a fixing method of a lens of the light source unit.

In an aspect, the present disclosure provides a light source unit including a substrate on which an excitation light source is mounted, a lens including a light transmitting portion that transmits light from the excitation light source and a body attached to the substrate, a first thermal expansion absorber that protrudes from the body and has high heat resistance and elasticity, and a cover fixed to the substrate in a state where the body of the lens is sandwiched between the cover and the substrate via the first thermal expansion absorber.

(Action) When the lens receives heat during the light emission of the excitation light source, only the first thermal expansion absorber that protrudes from the body and has elasticity is crushed between the cover and the body to absorb the thermal stress, and the light transmitting portion of the lens is thermally expanded while maintaining a similar shape to a predetermined shape without causing deformation of the shape.

Further, in the light source unit, the first thermal expansion absorber has a spherical shape.

(Action) Since a contact area between the cover and the first thermal expansion absorber is reduced in the initial state before the lens receives heat from the excitation light source, the first thermal expansion absorber is likely to deform uniformly after the lens receives heat.

Further, in the light source unit, the first thermal expansion absorber is formed of silicon.

(Action) Even with a lens provided with silicon having high thermal resistance and high thermal expansion coefficient, the light transmitting portion is thermally expanded while maintaining the similar shape by absorbing the thermal stress in the first thermal expansion absorber.

Further, the light source unit includes a pile fixing unit that fixes the body and the cover to the substrate by a first pile, and a second thermal expansion absorber including a second pile provided on one of the body and the substrate and an elongated hole provided on the other of the body and the substrate and configured to slidably hold the second pile.

(Action) The body that receives the heat from the excitation light source is thermally expanded while maintaining the similar shape in a plane direction of the body of the lens without being inhibited from the thermal expansion based on the sliding of the second pile along the elongated hole in a state of being fixed by a pile fixing substrate by the first pile.

Further, a fixing method of a lens of a light source unit includes providing an excitation light source on a substrate; and fixing a lens included in the light source and provided with a light transmitting portion that transmits light of an excitation light source on a substrate using a body. The body is sandwiched between the substrate and a cover via a first thermal expansion absorber that protrudes from the body and has high heat resistance and elasticity. Thus, the cover is fixed to the substrate.

(Action) When the lens receives heat during the light emission of the excitation light source, only the first thermal expansion absorber that protrudes from the body and has elasticity is crushed between the cover and the body to absorb the thermal stress, and the light transmitting portion of the lens is thermally expanded while maintaining a similar shape to a predetermined shape without causing deformation of the shape.

According to the light source unit, even when thermal expansion occurs in the lens, only the first thermal expansion absorber is crushed, and the body and the light transmitting portion are expanded while maintaining the similar shapes. Thus, deformation of the shape of the light transmitting portion hardly occurs.

According to the light source unit of the present disclosure, since the first thermal expansion absorber is likely to deform uniformly immediately after the lens receives heat, the first thermal expansion absorber is crushed in a predetermined shape without being biased. Thus, the body and the light transmitting portion that receive heat are more likely to be thermally expanded while maintaining the similar shapes, so that deformation of the shape of the light transmitting portion hardly occurs.

According to the light source unit, it is possible to form a lens having a light transmitting portion which is hard to deform its shape with inexpensive silicon or the like without forming a lens with expensive glass or the like so as to make it difficult to be thermally expanded. Thus, the manufacturing cost becomes low.

According to the light source unit, when the lens receives the heat from the excitation light source, only the first thermal expansion absorber is crushed so that the thermal stress acting in the thickness direction of the body of the lens is absorbed, and the second pile slides along the elongated hole in the second thermal expansion absorber so that the thermal stress acting in the plane direction of the body of the lens. Therefore, deformation of the shape of the light transmitting portion of the lens hardly occurs.

According to a fixing method of a lens of a light source unit of claims, even when thermal expansion occurs, only the first thermal expansion absorber is crushed, and the body and the light transmitting portion are expanded while maintaining the similar shapes. Thus, deformation of the shape of the light transmitting portion hardly occurs.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
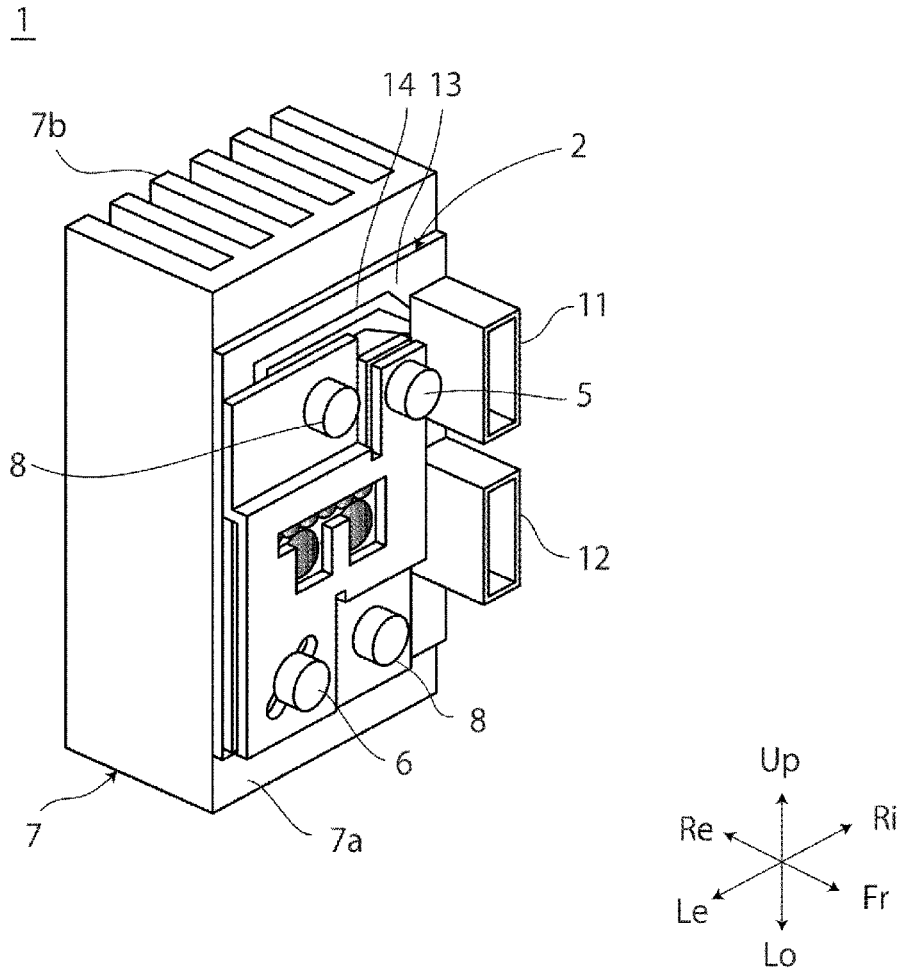
FIG. 1 is a perspective view illustrating a light source unit of an embodiment.

In the following detailed description, reference is made to the accompanying drawings, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, proper embodiments of the present disclosure will be described based on FIGS. 1 to 6. In respective drawings, respective directions of a light source unit are described as (upper:lower:left:right:front:rear=Up:Lo:Le:Ri:Fr:Re).

A light source unit of an embodiment will be described with reference to FIGS. 1 and 2. A light source unit 1 of a first embodiment is constituted by a substrate 2, a silicon lens 3, a metallic cover 4, a first mounting screw 5 serving as a first pile, a second mounting screw 6 serving as a second pile, a metallic supporting member 7 serving as a heat sink, and a pair of third mounting screws 8 illustrated in the respective FIGS. 5A to 5C.

Figure 2:
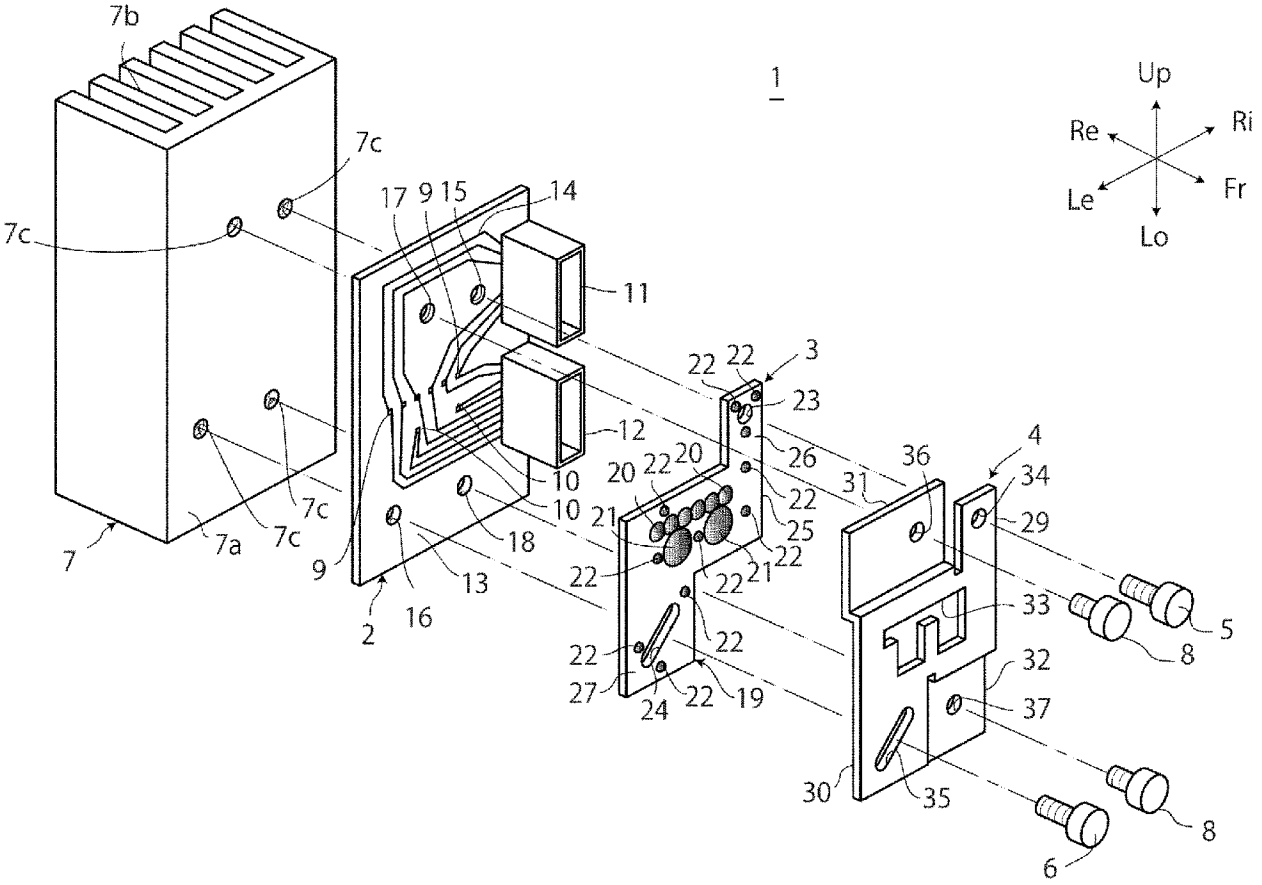
FIG. 2 is an exploded perspective view illustrating the light source unit of the embodiment.

As illustrated in FIG. 2, the substrate 2 is formed by mounting a plurality of first excitation light sources 9 (six in FIG. 2), a plurality of second excitation light sources 10 (two in FIG. 2), a power supply connector 11 that connects a power supply cable extending from a power source (not illustrated), and a control connector 12 that connects a control cable extending from a control device (not illustrated) to a polycarbonate substrate body 13.

The first and second excitation light sources 9 and 10 in FIG. 2 are formed by light emitting elements such as light emitting diodes (LEDs) or laser diodes, and the second excitation light sources 10 arranged laterally at a predetermined interval are arranged below the first excitation light sources 9 arranged laterally in one row. Each of the first and second excitation light sources 9 and 10 is connected to the power supply connector 11 and the control connector 12, respectively, by metallic conductive wires 14, is supplied with power from the power source (not illustrated) to be turned ON/OFF on the basis of control of the control device (not illustrated), and constitutes an excitation light source array used for, for example, a light distribution variable type vehicle headlamp. A first circular insertion hole 15 for the first mounting screw 5, a second circular insertion hole 16 for the second mounting screw 6, and third circular insertion holes 17 and 18 for the pair of third mounting screws 8 are formed on the substrate 2.

The silicon lens 3 illustrated in each of FIGS. 2 and 3A to 3C is a lens formed of a transparent or translucent high heat resistant elastic body, and has a body 19, first light transmitting portions 20 (six in FIGS. 2 and 3A to 3C) that respectively correspond to the plurality of first excitation light sources 9, second light transmitting portions 21 (two in FIGS. 2 and 3A to 3C) that respectively correspond to the plurality of second excitation light sources 10, a plurality of first thermal expansion absorbers 22, a fourth circular insertion hole 23 for the first mounting screw 5, and an elongated hole 24 into which the second mounting screw 6 is inserted.

Figure 3A:
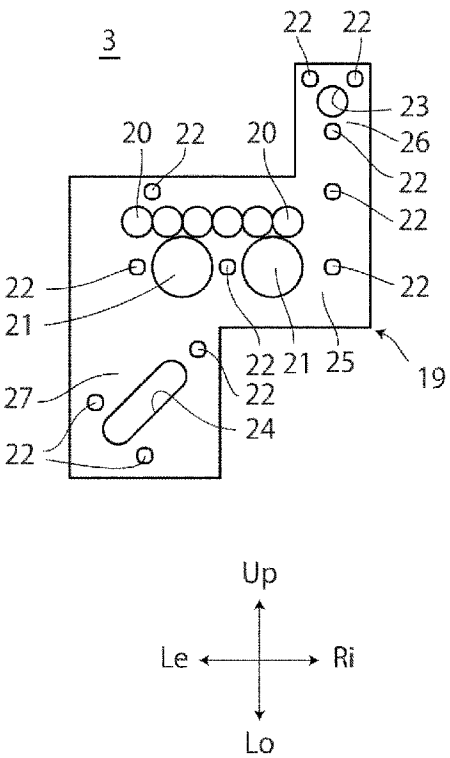
FIG. 3A is a front view of a lens.

As illustrated in FIG. 3A, the body 19 of the silicon lens 3 is formed in a flat plate shape, and is constituted by a base 24, a fixing portion 26 extending upward from a right end of the base 25, and a sliding portion 27 extending downward from a left end of the base 25.

The lens 3 is formed of silicon which is transparent or translucent, and has elasticity and high heat resistance so as not to cause plastic deformation even when receiving heat of at least 130° C., preferably 150° C. Therefore, the lens 3 may be formed of, instead of silicon, a material which is transparent or translucent, and has elasticity and the following high heat resistance (hereinafter, referred to as a high heat resistant elastic body), that is, for example, melamine having high heat resistance of about 130° C., or phenol, epoxy or the like having high heat resistance of about 150° C.

Further, in the present embodiment, as an example, the entire lens 3 including the body 19, the first light transmitting portions 20, the second light transmitting portions 21, and the first thermal expansion absorbers 22 is formed of silicon which is a high heat resistant elastic body. However, in other variations of the lens 3, only the first thermal expansion absorbers 22 that absorb thermal expansion may be formed of a high heat resistant elastic body such as silicon. Meanwhile, the body 19 and the first thermal expansion absorbers 22 which do not affect the transmission of light may be integrally formed as a high heat resistant elastic body and then other portions, that is, the first light transmitting portions 20 and the second light transmitting portions 21 that transmit light may be formed of a nonelastic member such as a transparent or translucent resin having high heat resistance.

Figure 3B:
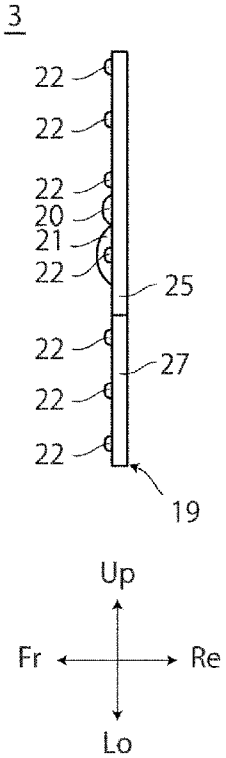
FIG. 3B is a right-side view of the lens.
Figure 3C:
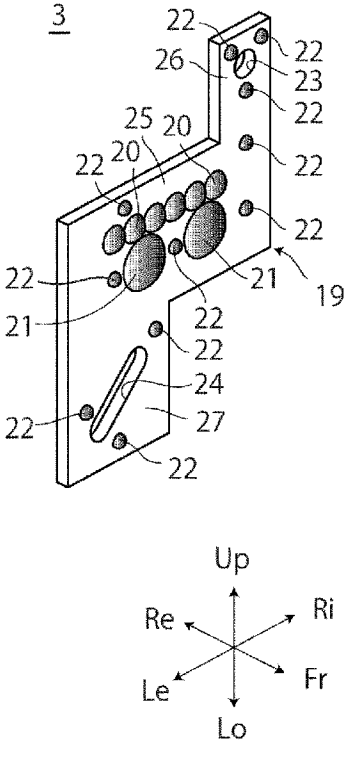
FIG. 3C is a perspective view of the lens.

As illustrated in FIGS. 3A to 3C, the plurality of first light transmitting portions 20, the second light transmitting portions 21, and the first thermal expansion absorbers 22 are formed in a dome shape which is a part of a spherical surface, and protrude to the front of the body 19. The plurality of first thermal expansion absorbers 22 are elastically deformed by receiving a force. The first light transmitting portions 20 are formed to be larger than the second light transmitting portions 21 in diameter and height, and the second light transmitting portions 21 are formed to be larger than the first thermal expansion absorbers 22 in diameter and height.

As illustrated in FIGS. 3A to 3C, all of the plurality of first light transmitting portions 20 and the second light transmitting portions 21 are formed on the base 25 of the body 19. On the base 25, a total of two first thermal expansion absorbers 22 are provided obliquely above the first light transmitting portion at the upper and right end of the plurality of first light transmitting portions 20. Further, a total of three first thermal expansion absorbers 22 are provided between the pair of second light transmitting portions 21, and the left and right side thereof.

As illustrated in FIGS. 3A to 3C, the fourth circular insertion hole 23 is formed on the fixing portion 26 at a position corresponding to the first circular insertion hole 15 of the substrate 2. On the fixing portion 26, three first thermal expansion absorbers 22 are provided around the fourth circular insertion hole 23.

Further, as illustrated in FIGS. 3A and 3C, the elongated hole 24 is formed on the sliding portion 27 to be extended obliquely upward from the left to the right, and formed at a position corresponding to the second circular insertion hole 16 of the substrate 2. On the sliding portion 27, three first thermal expansion absorbers 22 are provided around the elongated hole 24.

The number of the plurality of first thermal expansion absorbers 22 is not limited to the number proposed in the embodiment as long as the first thermal expansion absorbers 22 protrude to the front of the body 19 so as to avoid the first light transmitting portions 20, the second light transmitting portions 21, the fourth circular insertion hole 23, and the elongated hole 24.

Figure 4A:
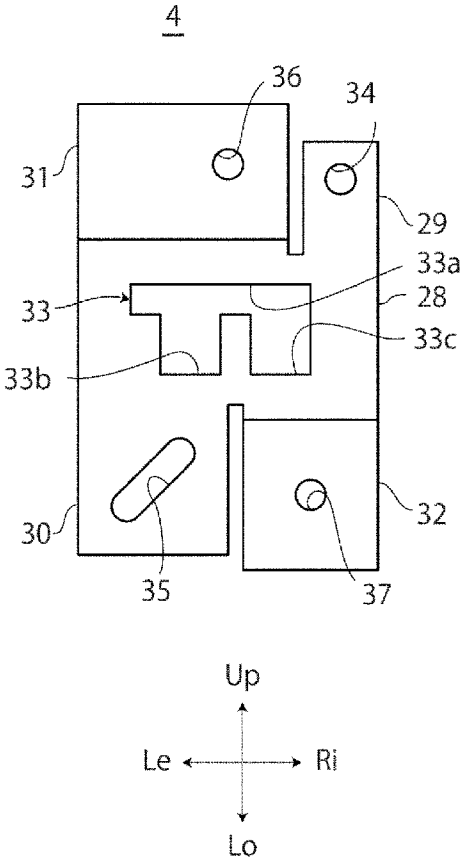
FIG. 4A is a front view of a cover.
Figure 4B:
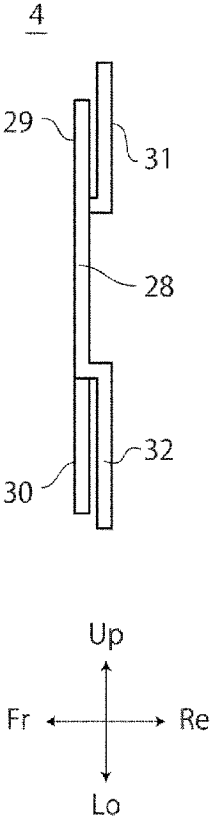
FIG. 4B is a right-side view of the cover.
Figure 4C:
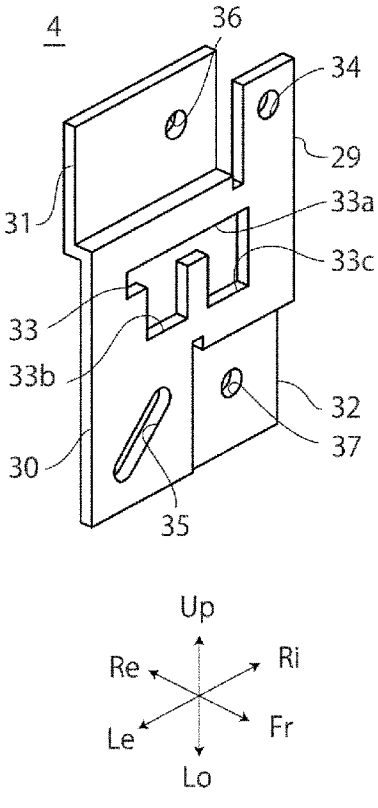
FIG. 4C is a perspective view of the cover.

The cover 4 illustrated in FIGS. 4A to 4C is formed of, for example, aluminum, stainless steel, or iron, which has high rigidity, and includes a cover body 28, a first arm portion 29, a second arm portion 30, a first fixing portion 31, and a second fixing portion 32. The cover body 28, the first arm portion 29, and the second arm portion 30 are formed in a plate shape. The first arm portion 29 is formed to be extended upward from the right end of the cover body 28, and the second arm portion 30 is formed to be extended downward from the left end of the cover body 28. The first fixing portion 31 is formed in a stepped shape so as to be bent from the left end of the cover body 28 to the rear side and then extended upward. The second fixing portion 32 is formed in a stepped shape so as to be bent from the right end of the cover body 28 to the rear side and then extended downward. The cover 4 is provided to the substrate 2 so as to cover the front side of the silicon lens 3.

As illustrated in each of FIGS. 4A to 4C and 5A to 5C, the cover body 28 is provided with an exposure window 33 formed by a first slit 33*a* that exposes the first excitation light sources 9 and second slits 33*b* and 33*c* that expose the plurality of second excitation light sources 10, respectively. The first arm portion 29 is provided with a fifth circular insertion hole 34 having the same shape as that of the fourth circular insertion hole 23 at a position corresponding to the fourth circular insertion hole 23 of the silicon lens 3 illustrated in FIG. 3A. The second arm portion 30 is provided with an elongated hole 35 having the same shape as that of the elongated hole 24 at a position corresponding to the elongated hole 24 of the silicon lens 3 illustrated in FIG. 3A. Further, the first fixing portion 31 is provided with a sixth circular insertion hole 36 having the same shape as that of the third circular insertion hole 17 at a position corresponding to the third circular insertion hole 17 of the substrate 2 in FIG. 2. The second fixing portion 32 is provided with a sixth circular insertion hole 37 having the same shape as that of the third circular insertion hole 17 at a position corresponding to the third circular insertion hole 18 of the substrate 2 in FIG. 2.

The metallic supporting member 7 illustrated in FIGS. 1 and 2 has four female screw holes 7*c* that are opened at a front surface 7*a*, and a plurality of heat radiation fins 7*b* extended rearward. The four female screw holes 7*c* are formed at positions respectively corresponding to the first circular insertion hole 15, the second circular insertion 16, and the third circular insertion holes 17 and 18 of the substrate 2. The metallic supporting member 7 functions as a heat sink that radiates the heat generated at the plurality of first and second excitation light sources 9 and 10 of the fixed substrate 2 from the heat radiation fins 7*b*.

Figure 5A:
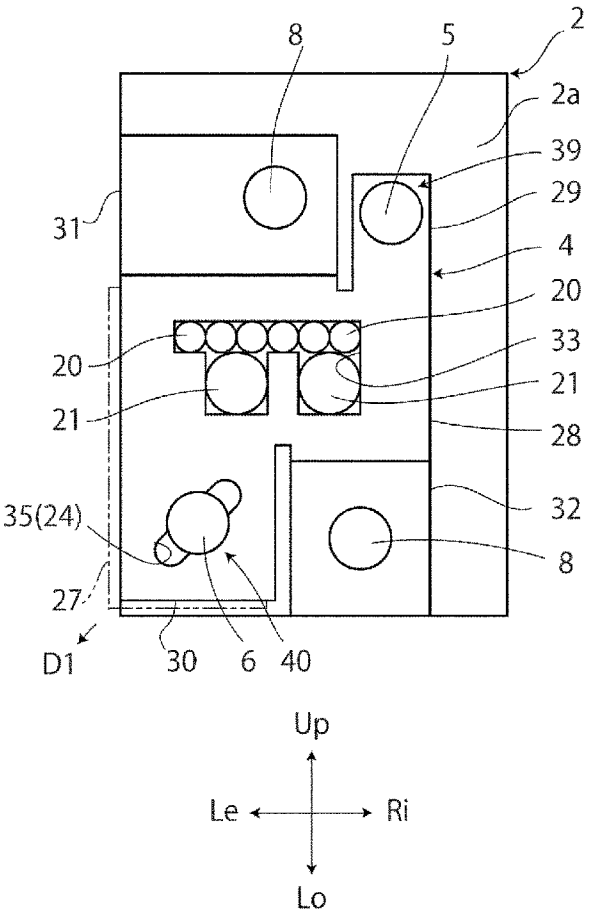
FIG. 5A is a front view of the light source unit excluding a heat sink.
Figure 5B:
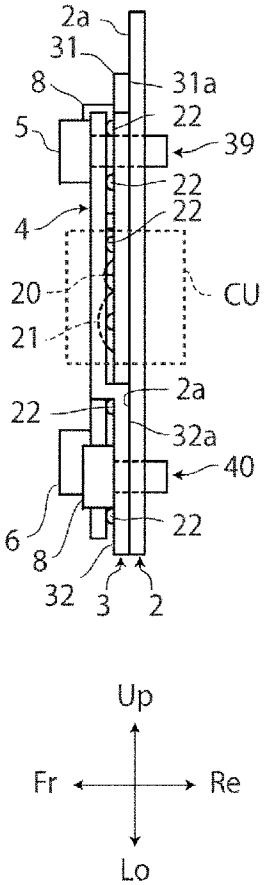
FIG. 5B is a right-side view of the light source unit excluding the heat sink.
Figure 5C:
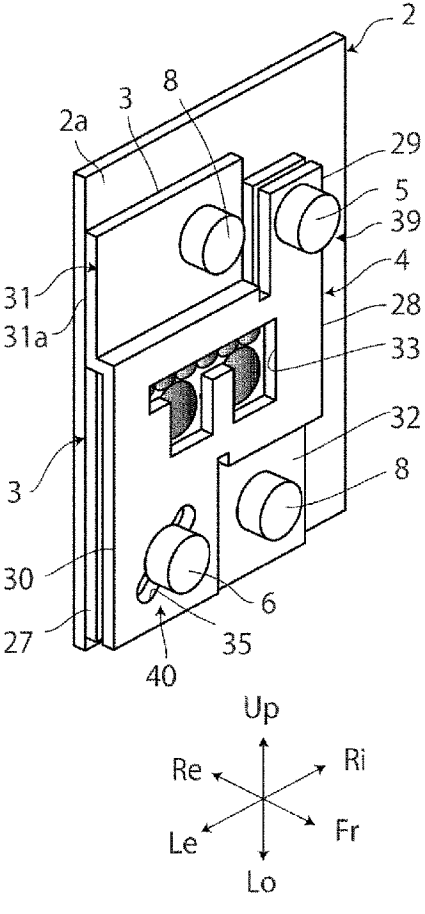
FIG. 5C is a perspective view of the light source unit excluding the heat sink.

The cover 4 illustrated in FIGS. 2, 5A, and 5C is screwed to the metallic supporting member 7 as described below while sandwiching the silicon lens 3 between the cover 4 and the substrate 2 by the first mounting screw 5, the second mounting screw 6, and the pair of third screws 8. First, the silicon lens 3 is sandwiched between the cover 4 and the substrate 2 in a state where the fifth circular insertion hole 34 of the cover 4, the fourth circular insertion hole 23 of the silicon lens 3, and the first circular insertion hole 15 of the substrate are overlapped, and further, the elongated hole 35 of the cover 4, the elongated hole 24 of the silicon lens 3, and the circular second insertion hole 16 of the substrate are overlapped.

In the state described above, the first mounting screw 5 illustrated in FIGS. 5A to 5C is inserted into the fifth circular insertion hole 34 of the cover 4, the fourth circular insertion hole 23 of the silicon lens 3, and the first circular insertion hole 15 of the substrate, the second mounting screw 6 is inserted into the elongated hole 35 of the cover 4, the elongated hole 24 of the silicon lens 3, and the second circular insertion hole 16 of the substrate, one of the third mounting screws 8 illustrated in FIGS. 2 and 5A to 5C is inserted into the sixth circular insertion hole 36 of the cover 4 and the third circular insertion hole 17 of the substrate, and the other one of the third mounting screws 8 is inserted into the sixth circular insertion hole 37 of the cover 4 and the third circular insertion hole 18 of the substrate, so that the first mounting screw 5, the second mounting screw 6, and the pair of third mounting screws 8 are screwed to the corresponding female screw holes 7*c* formed on the front surface 7*a* of the metallic supporting member 7, respectively.

Therefore, the first fixing portion 31 and the second fixing portion 32 of the cover 4 illustrated in FIGS. 2, 4B, and 5A to 5C are integrated with the substrate 2 while closely contacting respective rear surfaces 31*a* and 32*a* to a front surface 2*a* of the substrate 2 as illustrated in FIG. 5B, so that the cover body 28, the first arm portion 29, and the second arm portion 30 of the cover 4 are held on the substrate 2 together with the silicon lens 3 in a state of being brought into contact with a front end portion of the plurality of thermal expansion absorbers 22 that protrude from the body 19 of the silicon lens 3 as illustrated in FIG. 5B.

Further, the first mounting screw 5 that is the first pile screwed to the female screw hole 7*c* of the metallic supporting member 7, the fifth circular insertion hole 34 of the cover 4, the fourth circular insertion hole 23 of the silicon lens 3, and the first circular insertion hole 15 of the substrate constitute a pile fixing unit 39 that fixes the body 19 of the lens 3 to the substrate 2. Further, the second mounting screw 6 that constitutes the second pile provided on the substrate 2 by screwing to the female screw hole 7*c* of the metallic supporting member 7, and the elongated hole 24 that holds the second mounting screw 6 provided on the body 19 of the silicon lens 3 and inserted into the elongated hole to freely slide constitute a second thermal expansion absorber 40.

Figure 6:
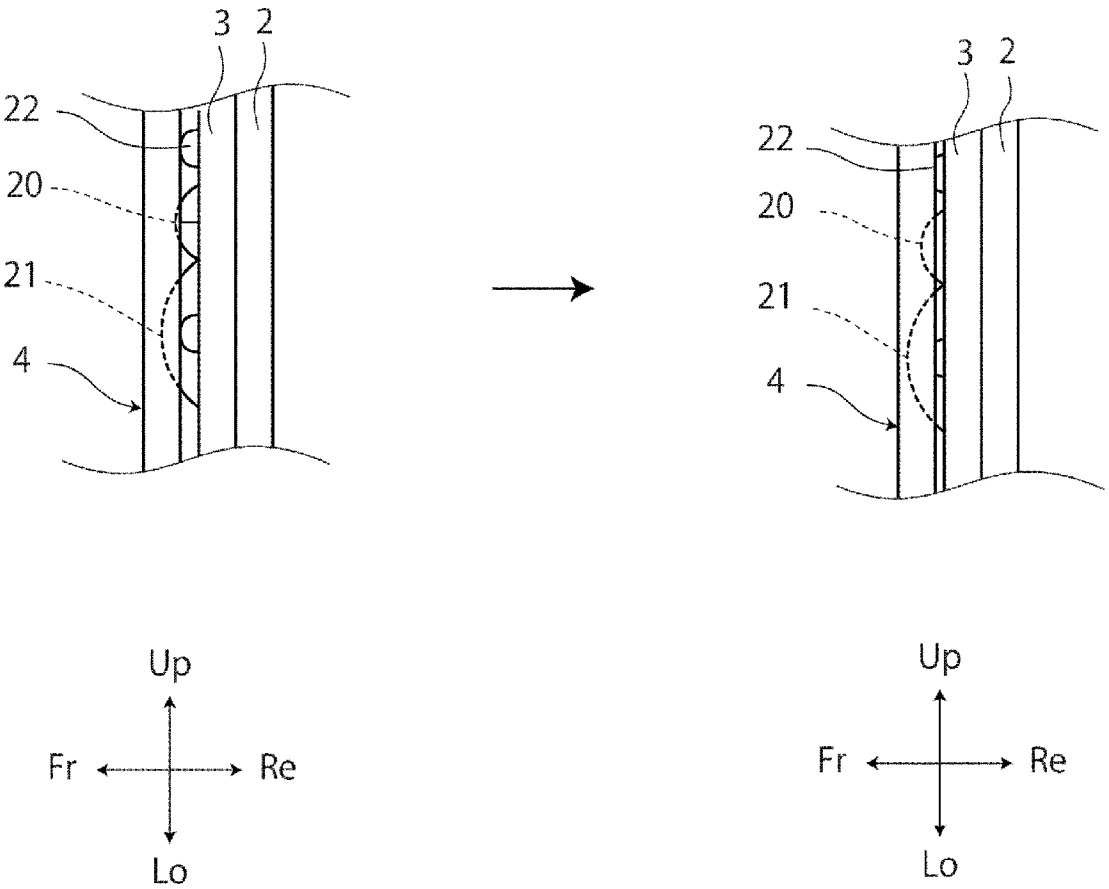
FIG. 6 is an enlarged right-side partial view of the light source unit illustrating a CU portion in FIG. 5B.

When thermal expansion occurs in the silicon lens 3, the plurality of first thermal expansion absorbers 22 illustrated in FIG. 5B absorb the thermal expansion that occurs in the thickness direction of the silicon lens 3 by being crushed back and forth as illustrated in FIG. 6 (an enlarged view of a CU portion in FIG. 5B). Further, when thermal expansion occurs in the silicon lens 3, the second thermal expansion absorber 40 absorbs the thermal expansion that occurs in the plane direction (vertical and horizontal directions) of the silicon lens 3 by sliding the sliding portion 27 in a D1 direction along the elongated hole 24.

In the silicon lens 3 illustrated in FIGS. 5A and 5B, the thermal expansion that occurs in the thickness direction is absorbed by the plurality of first thermal expansion absorbers 22, and further, the thermal expansion that occurs in the plane direction is absorbed by the second thermal expansion absorber 40, so that thermal distortion that occurs in the first light transmitting portions 20 and the second light transmitting portions 21 is suppressed. Therefore, even when the silicon lens 3 thermally expands, the light distribution of the light transmitting the first light transmitting portions 20 and the second light transmitting portions 21 is not affected.

In the present embodiment, the second mounting screw 6 serving as the second pile is provided on the substrate 2 by screwing to the metallic supporting member 7, and the elongated hole 24 is formed in the body 19 of the silicon lens 3. However, even when the second mounting screw 6 is provided on the body 19 of the silicon lens 3 by configuring the elongated hole 24 of the silicon lens 3 as a female screw hole, configuring the second circular insertion hole 16 of the substrate 2 as an elongated hole, and screwing the second mounting screw 6 serving as the second pile to the female screw hole of the body 19 of the silicon lens 3 in a state where the tip of the second mounting screw 6 is inserted into the elongated hole of the substrate 2, the same operation effect as that of the present embodiment may be obtained.

Further, after attaching the substrate 2 to the metallic supporting member 7, the first mounting screw 5, the second mounting screw 6, and the pair of third mounting screws 8 may be screwed to the substrate 2 by configuring the first circular insertion hole 15, the second circular insertion hole 16, and the third circular insertion holes 17 and 18 of the substrate 2 as the female screw holes, respectively. Further, the plurality of first thermal expansion absorbers 22 may be formed in, for example, a triangular pyramid shape, a columnar shape instead of a spherical shape. However, when thermal expansion occurs in the silicon lens, the spherical shape is most desirable in that the first thermal expansion absorbers are equally pressed and crushed.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A light source comprising:

a substrate on which an excitation light source is mounted;

a lens including a light transmitting portion that transmits light from the extraction light source and a body attached to the substrate;

a first thermal expansion absorber that protrudes from the body and has high heat resistance and elasticity, and a cover fixed to the substrate in a state where the body of the lens is sandwiched between the cover and the substrate via the first thermal expansion absorber, wherein the first thermal expansion absorber directly contacts the cover.

2. The light source according to claim 1, wherein the first thermal expansion absorber has a spherical shape.

3. The light source according to claim 1, wherein the first thermal expansion absorber is formed of silicon.

4. The light source according to claim 2, wherein the first thermal expansion absorber is formed of silicon.

5. The light source according to claim 1, further comprising:

a first mounting screw that fixes the body and the cover to the substrate; and a second thermal expansion absorber including a second mounting screw, a screw hole provided on one of the body and the substrate and an elongated hole provided on the other of the body and the substrate, wherein the second mounting screw is configured to slidably hold the body, the cover and the substrate together.

6. The light source according to claim 2, further comprising:

a first mounting screw that fixes the body and the cover to the substrate; and a second thermal expansion absorber including a second mounting screw, a screw hole provided on one of the body and the substrate and an elongated hole provided on the other of the body and the substrate, wherein the second mounting screw is configured to slidably hold the body, the cover and the substrate together.

7. The light source according to claim 3, further comprising:

a first mounting screw that fixes the body and the cover to the substrate; and a second thermal expansion absorber including a second mounting screw, a screw hole provided on one of the body and the substrate and an elongated hole provided on the other of the body and the substrate, wherein the second mounting screw is configured to slidably hold the body, the cover and the substrate together.

8. The light source according to claim 4, further comprising:

a first mounting screw that fixes the body and the cover to the substrate; and a second thermal expansion absorber including a second mounting screw, a screw hole provided on one of the body and the substrate and an elongated hole provided on the other of the body and the substrate, wherein the second mounting screw is configured to slidably hold the body, the cover and the substrate together.

9. A fixing method of a light source comprising:

providing an excitation light source on a substrate; and fixing a lens included in the light source and provided with a light transmitting portion that transmits light of the excitation light source on a substrate using a body, wherein the body is sandwiched between the substrate and a cover via a first thermal expansion absorber that protrudes from the body, has high heat resistance and elasticity, and directly contacts the cover, and the cover is fixed to the substrate.

* * * * *